US011300000B2

(12) United States Patent
Beltrán París

(10) Patent No.: US 11,300,000 B2
(45) Date of Patent: Apr. 12, 2022

(54) PANEL FOR TIP CLEARANCE CONTROL

(71) Applicant: ITP EXTERNALS, S.L., Derio (ES)

(72) Inventor: José Francisco Beltrán París, Derio (ES)

(73) Assignee: ITP EXTERNALS, S.L., Derio (ES)

( * ) Notice: Subject to any disclaimer, the term of this patent is extended or adjusted under 35 U.S.C. 154(b) by 0 days.

(21) Appl. No.: 17/039,802

(22) Filed: Sep. 30, 2020

(65) Prior Publication Data

US 2021/0095575 A1 Apr. 1, 2021

(30) Foreign Application Priority Data

Oct. 1, 2019 (EP) ..... 19382844

(51) Int. Cl.
*F01D 11/24* (2006.01)
*F01D 11/12* (2006.01)

(52) U.S. Cl.
CPC ..... *F01D 11/24* (2013.01); *F01D 11/12* (2013.01); *F05D 2230/312* (2013.01); *F05D 2240/55* (2013.01); *F05D 2260/201* (2013.01); *F05D 2260/231* (2013.01); *F05D 2260/232* (2013.01)

(58) Field of Classification Search
CPC ..... F01D 11/08; F01D 11/12; F01D 11/24; F05D 2240/55; F05D 2260/201; F05D 2260/231; F04D 29/582; F04D 29/584
See application file for complete search history.

(56) References Cited

U.S. PATENT DOCUMENTS 5,993,150 A * 11/1999 Liotta ..... F01D 11/10 415/115
7,597,537 B2 * 10/2009 Bucaro ..... F01D 11/24 415/136
9,869,196 B2 * 1/2018 Day ..... F01D 11/24
2007/0140839 A1 * 6/2007 Bucaro ..... F01D 11/24 415/178
2009/0053042 A1 * 2/2009 Wilson ..... F01D 11/20 415/134
2017/0114667 A1 * 4/2017 Sabo ..... F02C 3/04

FOREIGN PATENT DOCUMENTS

EP 1798381 A2 6/2007
EP 3159493 A1 4/2017

OTHER PUBLICATIONS

Extended European Search Report for European Patent Application No. 19382844.9, dated Apr. 1, 2020, in 7 pages.

* cited by examiner

*Primary Examiner* — Eldon T Brockman

(74) *Attorney, Agent, or Firm* — Knobbe, Martens, Olson & Bear, LLP

(57) ABSTRACT

The present invention relates to a panel for tip clearance control formed by: a first perforated sheet adapted for being seated on the turbine casing; a second sheet arranged on said first sheet and configured for being attached to the first sheet leaving a gap between both sheets; and a third sheet arranged between both first sheet and second sheet such that respective spaces in fluid connection by at least one hole are configured: a distribution chamber and an impingement chamber, both chambers extending from one end of the panel to the other. The panel further comprises a closure element together with a sealing element at one of its lateral ends for allowing the passage of fluid with another adjacent panel, whereas the sealing element is configured for allowing relative movement between both adjoining panels.

21 Claims, 11 Drawing Sheets

PANEL FOR TIP CLEARANCE CONTROL

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

OBJECT OF THE INVENTION

The present invention relates to an assembly of self-supporting panels adapted for being placed on a compressor or turbine casing for tip clearance control (TCC) when said turbine or compressor is in operation.

In particular, each of these panels includes two chambers, an upper panel communicating with adjacent panels and another lower panel, closer to the casing, and the surface of which that is closer to the casing (but separated from same) is perforated to enable impingement in the casing. Thus, the assembly of panels integrates both air chambers and favors better air (and, hence, temperature) distribution, minimizing possible leakages or losses.

Furthermore, in detailed embodiments of the invention, a system for supporting these panels on the casing is proposed, enabling relative movement between them with thermal expansion of the casing.

BACKGROUND OF THE INVENTION

As is well known, during the operation of a turbomachine such as the engine of an airplane, its internal components are exposed to high loads either due to heat or the centrifugal forces that are generated.

Among them, operation of the turbine is particularly delicate because said turbine, namely its high-pressure stages, are directly confronted with hot gases coming from the combustion chambers for generating energy.

This causes expansion of these stages and alters the available space between the blade tips of the turbine and the casing that covers it, either reducing or enlarging it. If this space were to be enlarged, the amount of air getting out between the blades would increase, which will have a negative effect on engine performance and fuel consumption.

For this reason, it is common to install a TCC system around the casing. After receiving the air that has been bled off from the fan, or even from stages of the compressor, it is circulated in a controlled manner by the TCC system until being impinged in the casing.

By means of perforations on the lower face thereof, the one facing the casing, this recirculated air is accelerated by the Venturi effect, causing it to accelerate and impinge on the casing, cooling the cover thereof (which can reach more than 800° C.) and causing its shrinkage. Upon shrinkage, the tip clearance is likewise reduced.

Today, the TCC systems are made up of impingement chambers placed in the turbine casing as well as of an air distribution duct in charge of receiving the cooling air and conveying it around the casing to said impingement chambers, on an isolated basis (i.e., one feeding point per chamber) by means of elbow fittings provided for that purpose.

These chambers are separated from one another and each one covers a portion of the turbine casing. Their securing, which must allow the casing to expand, is produced by a series of securing elements arranged in segments and supported on an engine flange for them to act as a bearing for the chambers, which must be at a controlled distance from the casing for correct operation of the impingement air.

This securing is based on nuts and bolts, which normally involve added weight and complexity, while at the same time increases the probability of failure.

Besides physically separating the chambers, the use of "bellows" type connections between sections of the duct confers flexibility to the system for absorbing relative movements without affecting integrity.

In turn, it is known that to service the turbine or monitor its operation, it is necessary to allow the passage of sensors (e.g. temperature sensors such as TGT, "turbine gas temperature", sensors), or access for borescopes, among others, to the casing. This means the provision of cut-outs in the impingement chambers which leads to extensive "shadow regions" that reduce efficiency and promote the undesired occurrence of hot spots in the assembly.

Once inside the impingement chamber, the air coming from the distribution duct must travel a long distance from this feeding point to the final holes of the lower face (those arranged for impingement). This causes the temperature of the air to vary (i.e., increase), a "heat pick-up" process, when moving away from the only feeding point in each impingement panel.

Furthermore, if the impingement chamber is placed opposite the point where the distribution duct receives the cooling air (in the event that there is only one), the path travelled by this air (along which its temperature will gradually increase) to the feeding point of that opposite chamber must be taken into account.

In general, this conventional TCC system presents associated pressure drops in the course from the feed with cooling air (which, since it comes from the fan, for example, already had marginal pressure) to the impingement surface given its multiple derivations, elbow fittings with a small radius, sealed interfaces (which are potential air loss or leakage points), as well as its complex design in general.

Furthermore, this conventional TCC system has high associated air leakages due to the separation with the casing running either between panels or through the mentioned cut-outs and, accordingly, does not collaborate in the process of cooling the casing and in turn reduces assembly efficiency.

For these reasons, it is necessary to provide a simpler TCC system capable of maximizing the amount of air impinged in the casing in conditions suitable for cooling.

SUMMARY

The present invention proposes a solution to the foregoing problems by means of a panel for tip clearance control according to claim 1, a system formed by a plurality of these panels according to claim 10, an assembly according to claim 12, an assembly method for assembling a tip clearance control system according to claim 13, and a securing system for securing a panel on a casing according to claim 15.

In a first inventive aspect, the invention provides a panel for tip clearance control adapted for being placed on a compressor or turbine casing covering an arc portion thereof, wherein the panel is formed by:

- a first perforated sheet adapted for being arranged on said arc portion of the turbine casing; said first sheet defining two axes, a longitudinal one (x-x') and another circumferential one (y-y'), wherein said first perforated sheet further comprises a front end and a rear end, both substantially parallel to the circumferential axis; as well as two lateral ends substantially parallel to the longitudinal axis;

a second sheet arranged on said first sheet and configured for being attached in a leak-tight manner at its front end and rear end, leaving a gap between both sheets; and a third sheet arranged between the first sheet and second sheet, configuring respective gaps with both sheets such that the third sheet forms together with the second sheet a distribution chamber, whereas it forms with the first sheet an impingement chamber, both chambers extending from one lateral end of the panel to the other; wherein said third sheet comprises at least one hole for the passage of fluid between both chambers;

wherein the panel further comprises a closure element together with a sealing element at least at one of the lateral ends of the panel, said closure element being configured for allowing the passage of fluid with another adjacent panel, whereas the sealing element is configured for allowing relative movement between both adjoining panels.

In use, i.e., when the panel is placed on the casing, the axes defined by the first sheet, the longitudinal axis (x-x') and circumferential axis (y-y'), are parallel to those defined by the turbine or compressor that are part of the turbomachine, its longitudinal axis (x-x') going through it from the center of the air intake to the outlet nozzle, and the circumferential axis (y-y') being orthogonal to the preceding axis.

This panel has dimensions such that it covers an arc portion of the casing once it is placed thereon. In other words, if the casing in its entirety covers a complete 360° circle, the panel covers an arc of X° degrees of the 360°, its respective sheets preferably being curved.

Furthermore, this panel is considered the minimum unit (to be repeated) of an assembly of panels which is defined in other inventive aspects encompassed as a system. For this reason, in one embodiment, each panel (assuming that there is a number "N" of them) will cover an arc of the casing equal to the rest of them and it is a division of 360°. In other words, X° is equal to 360°/N.

One skilled in the art will recognize that once the circumferential axis (y-y') of a panel is defined, the circumferential axis of the rest of the panels forming the system will follow a criterion of tangentiality with respect to the circular arrangement of the casing, with these respective circumferential axes accordingly being angularly displaced with respect to one another.

It should be pointed out that the definition of the front end and rear end, as well as the two lateral ends, all of which are defined from the first sheet, are likewise applicable to the rest of the sheets (second sheet or third sheet) and even to the whole panel.

"Substantially" parallel will be understood to mean that these ends (i.e., their edges) may be either parallel to these axes or may have a certain angle. These minimum angles may even be variable from panel to panel, for example alternating V-shaped and A-shaped configurations.

The distance between the rear end and the front end of the first sheet, and hence of the panel, can preferably cover a specific number of turbine stages, or even completely cover all of them. The same occurs if it is arranged in a compressor casing. Throughout this description, the components of turbine and compressor will be understood to be equivalent for purposes of the panels of the invention, with the exception that the high and low stages in each of them are interchanged with respect to the start of the engine.

Thus, by taking the arrangement of the first sheet on a turbine casing as an example, its rear end (i.e., its rear edge) will be placed closer to the outlet of the turbine, i.e., the face connecting with the nozzle. In turn, its front end (i.e., its front edge) will be arranged closest to the inlet, i.e., the face designed for receiving the hot gases coming from the combustors.

A second sheet, which acts like an outer cover of the panel, is arranged on the first sheet and the attachment thereof is sealed at said rear end and front end to prevent undesired air leakages. The gap that is left between both sheets is the sum of the distribution chamber and the impingement chamber.

The separation between both chambers will be produced as a consequence of having a third sheet between them, enabling the transit of air from the distribution chamber to the impingement chamber through the at least one hole thereof.

The panel further comprises, at least at one of its lateral ends, a closure element which channels the passage of air with an adjacent panel. However, when the turbine (or compressor) is operating and the temperature rises, thermal expansion of its casing will occur, causing the separation of the adjoining panels.

If the closure elements were rigidly attached to both adjoining panels, the latter would be subjected to tensile stresses upon pulling on the panels thereof when they are forced to open. As a result, the panel according to the invention furthermore provides, together with said closure element, a sealing element which allows relative movement between both adjoining panels. This relative movement may manifest either in terms of lateral displacement or rotation (angular misalignment) between both.

Thus, the air circulating through the distribution chamber passes through the at least one hole of the third sheet into the impingement chamber where, upon running into the first perforated sheet, this air will exit the panel to the casing through these perforations. As they are small-sized, the air accelerates, thus increasing its cooling power and rendering it more effective in TCC when this air impinges in a controlled and localized manner on the casing.

It should be mentioned that unlike solutions of the state of the art where the duct and impingement chamber are separated, in addition to the fact that these chambers were physically separated from one another, the present invention proposes a compact panel integrating both (distribution and impingement) chambers, which represents a significant reduction in weight and volume (i.e., reduction of the space occupied in the engine), which can reach the order of 35% also as a result of the elimination of auxiliary elements for the separate securing of the duct, the chambers, the elimination of nuts and bolts, etc.

As it is formed by three sheets attached to one another, said panel is furthermore provided with a high adaptability, and this is because both the density (in number and size) of holes of the first perforated sheet and the holes of the third sheet for communicating both chambers can be modified based on the operating conditions of the turbine or compressor and the expected level of operation in tip clearance control, without having to change the basic mechanical design of the panel.

Accordingly, the distribution of air in the chambers is completely adaptable, which has a favorable impact on the functionality and operations of the TCC system. For example, it allows reducing the heat pick-up (i.e., undesired increase in cooling temperature as the air is forced to be there for a longer time or travel a longer distance) effect as it can be fed (by means of holes in the third sheet) from points closest to the perforations of the first sheet, which achieves a lower and more uniform impingement air temperature.

In a secondary manner, since the gap between panels is eliminated, a larger impingement coverage area is achieved, without hot spots in the casing.

As a result of all this, pressure drops are noticeably reduced due to the elimination, inter alia, of elbow fittings and abrupt transitions. Once the panel system is assembled, it integrates a single ring where the air circulates in the circumferential direction with barely any restrictions, changes in direction, etc. Notwithstanding the fact that the geometry thereof can be accommodated to achieve smooth transitions, the only reductions in area would appear in a localized manner in the interface between panels for the housing of the closure and sealing elements.

In a preferred embodiment, the first perforated sheet, and/or the second perforated sheet, and/or the third perforated sheet are made of sheet metal.

In a particular embodiment:

- the first perforated sheet further comprises at least one recess; and
- the second sheet further comprises at least one prominence;
- such that said at least one recess and at least one prominence of respective sheets coincide with one another so that when the recess is supported on the prominence a seating is formed.

It must be taken into account that the terms "recess" (or concavity) and "prominence" are taken from the perspective of the first sheet. Be that as it may, the presence of both produces slots in the outer part of the panel, so both "recess" and "prominence" are oriented towards one another for contact thereof.

As already mentioned, the casing incorporates a series of accesses for the passage of sensors. These accesses are known as bosses and form planar locations to provide a stable installation and at the same time control the inclination of the sensors to be introduced. In specific embodiments, these bosses take the shape of guidance sleeves for the passage of the sensors, which project from the plane of the casing and form, at one of their ends, the planar locations.

Unlike conventional systems where these passages were avoided, even defining the region of separation between adjoining chambers, this embodiment takes advantage of said installations to use them as bearing points of the panel.

More specifically, the seatings formed by recess-prominence pairs are made to coincide with these planar locations, in the bosses, of the casing to be supported thereon.

It should also be pointed out that these passage locations of the casing can either have an opening for the passage of sensors by reusing those that are already present, or they can be intentionally included where needed so that they can support the panels, and in this latter case they can be blind (i.e., they do not present a hole).

Thus, the shadow regions where there was no impingement capacity in conventional TCC systems are drastically reduced with the present embodiment, and a lower and more uniform temperature record can thereby be achieved.

As a result of all this, a dual function is achieved with this embodiment; on one hand, the bosses or their planar locations in the casing are taken advantage of, whereas on the other hand, air leakages as well as shadow regions are minimized.

Advantageously, this embodiment reduces weight as the stair-type securing elements or their associated nuts and bolts are no longer required.

In a preferred embodiment, at least one recess of the first perforated sheet further comprises a hole; and the at least one prominence of the second sheet further comprises a hole similar to that of at least one recess of the first perforated sheet, respective holes of the recess and of the prominence, forming the seating, being adapted for the passage of sensors to the casing.

To complete said bearing, in a particular embodiment, the panel, in any of its sheets, further comprises at least one lug at its rear end adapted for stabilizing the seating of the panel on the turbine casing.

This lug can be an integral element of the starting sheet or an element that is later attached by means of welding, for example.

In a particular embodiment:

- the second sheet is divided according to the longitudinal direction into a front section and a rear section, each one extending to its lateral ends; wherein said rear section is prominent with respect to the front section so as to form the distribution chamber together with the third sheet; and
- the third sheet has an extension substantially similar to said rear section of the second sheet in order to seal its perimeter and thus prevent the passage of air to the impingement chamber through the attachment between the second sheet and third sheet.

In other words, the second sheet is divided according to the longitudinal direction (and along its circumferential direction, i.e., from lateral end to lateral end) into the front section and rear section.

That is, the perimeter of the prominence of the second sheet, which corresponds to the rear section, is sealed with the third sheet, channeling the entire passage of air into the impingement chamber through the at least one hole of this third sheet.

This allows the distribution chamber to have a smaller extension (in terms of projection on the casing) than the impingement chamber to prevent the rise in temperature of the air as it travels through the panels.

It should be pointed out that this first sheet, and/or second sheet, and/or third sheet can be made up of smaller portions of sheets attached to one another by means of welding, for example, forming the three sheets according to the invention in their final configuration.

For this reason, in a particular embodiment, the sheets of the panel according to the invention are formed from three starting sheets according to:

- a starting sheet comprising the front section of the second sheet and the third sheet;
- another starting sheet comprising the rear section of the second sheet; and
- another starting sheet comprising the first perforated sheet.

The attachment, by means of welding for example, of these first two starting sheets results in the second sheet and third sheet according to the present invention.

In a particular embodiment, the third sheet further comprises at least one notch adapted to the shape of the at least one recess and of the at least one prominence of the first sheet and second sheet, respectively.

Advantageously, this aids in the correct positioning of the second sheet and allows slightly increasing the extension of the distribution chamber.

In a particular embodiment, the second sheet further comprises an air inlet in fluid communication with the distribution chamber.

This air inlet is in fluid communication with bleed-off ports of the compressor or fan for receiving the bled-off air which will subsequently be circulated through the distribution chamber.

In the event that the casing had dimensions such that they made the feed to the panels through a single point inadequate, two or more panels according to this embodiment could be arranged to cool the casing as uniform as possible.

In a particular embodiment, said air inlet of the second sheet further comprises a distributing element configured for splitting an air inflow into branches, preferably two opposite branches.

In a preferred embodiment, this distributing element is integrated within the distribution chamber of the panel.

In a particular embodiment, the closure element is configured for sealing or closing an end of the impingement chamber between the first sheet and third sheet, while at the same time allowing the passage of air to or from the distribution chamber of an adjacent panel between the second sheet and third sheet, whereas the sealing element is configured for contacting an adjacent panel such that it seals against fluid leakages at the distribution chamber between panels, i.e., between the second sheet and third sheet.

More specifically, the sealing element is configured for contacting a closure element of the adjacent panel such that it seals against leakages in the passage of the distribution chamber between adjoining panels.

It should be mentioned that the sealing against these leakages by means of the sealing element is preferably radial with respect to the contour demarcated by the second sheet and third sheet.

In a particular embodiment, at least one sealing element is preferably a metallic bellows-type seal. Advantageously, this allows installing mature technology which facilitates the certification processes.

In a particular embodiment, the at least one closure element is integrally attached along the entire contour of a lateral end of the panel formed by the first sheet and second sheet, the closure element comprising:

- a sealing plate for the end of the impingement chamber, and
- a ridge which laterally extends the contour defined between the second sheet and third sheet such that the passage of air therethrough is allowed; wherein said ridge comprises means for retaining the sealing element.

Advantageously, this embodiment allows both the level of rotation and displacement necessary for the assembly of the panels in the casing.

Furthermore, this embodiment accepts both thermal expansions and deformations originated from the assembly or caused by the operation. Moreover, since it is integrated in the panel it does not require additional elements which entail cost and weight.

In a particular embodiment, the at least one closure element is integrally attached along the entire contour of a lateral end of the panel formed by the first sheet and second sheet, the closure element comprising:

- a sealing plate for the end of the impingement chamber, and
- a ridge on the contour defined between the second sheet and third sheet such that the passage of air therethrough is allowed; and this ridge being adapted for supporting a sealing element of an adjoining panel.

In other words, there is a "male"-type closure element at one end of the panel configured for cooperating with another "female"-type closure element of the adjoining panel.

In a preferred embodiment, one and the same panel comprises at each of its lateral ends one of these variants of the closure element, i.e., at one of its ends it comprises a closure element with the means for retaining the sealing element; whereas at its opposite end the ridge of its closure element is adapted for supporting a sealing element of an adjoining panel.

In a preferred embodiment, the external perimeter of the ridge of the closure element does not transversely go beyond the contour defined between the second sheet and third sheet so that a homologous adjoining panel can be arranged.

As an alternative to the preceding embodiment, the external perimeter of the ridge does transversely project so as to externally arrange the sealing element. Advantageously, as the area of passage is not reduced, this embodiment involves fewer pressure drops.

In one embodiment, the means of the ridge for retaining the sealing element are based on said ridge having a geometry such that it enables the retention of said sealing element. Examples of this type can be E-shaped sections, with an elastic gasket (acting as a sealing element) being retained between it two outermost tips.

Therefore, in another embodiment, said ridge is in the form of two troughs interposed on a plane, the sealing element being retained at its outermost trough.

In a preferred embodiment, said sealing element is a O-ring type elastic gasket, preferably elastomeric. Optionally, said sealing element can also be a metallic C-seal, braided seal, or packing seal, among others.

In a particular embodiment, the panel further comprises a blocking element at the opposite lateral end of the panel with respect to the one where the closure element is placed, said blocking element being configured for sealing or closing said end between the first sheet and second sheet, or in other words, for sealing an end of both the impingement chamber and the distribution chamber.

That is, the panel according to this embodiment would be arranged at the opposite end of that panel, the second sheet of which further comprises the air inlet for the purpose of sealing one of the branches of the distribution channel.

Preferably, the system made up of an assembly of panels as described below comprises two panels with respective blocking elements (for a configuration with two branches), or there will be as many of these panels as there are air branches comprised in the system.

In a particular embodiment, the first sheet and/or the third sheet comprise a thermal insulation at least on one of their respective faces.

In a preferred embodiment, the first sheet on its face opposite the casing, the third sheet on its face opposite the impingement chamber, or both sheets comprise a thermal insulation applied, for example, by means of plasma spraying.

In those applications where the heat pick-up must be even further reduced, this thermal barrier can be used, for example, for the air circulating through the distribution chamber to be even further isolated or applied on the face closest to the casing of the first sheet, or even to reduce the temperature to which both the closure element and the sealing element between panels are exposed.

In a second inventive aspect, the invention provides a tip clearance control system formed by a plurality of panels according to any of the embodiments of the first inventive aspect; wherein at least one of said panels further comprises an air inlet in fluid communication with the distribution chamber.

By comparison, with respect to conventional TCC systems which gave rise to a pressure drop of around 2 kPa from the feed into the system to the outlet of the impingement chambers, the panel system according to the present invention achieves reducing these drops to 0.1 kPa.

Due to the fact that the panels are not secured directly to the casing, except by the seatings on the bosses and the rear lugs (if there are any), there is a controlled distance between the first perforated sheet and the casing whereby, during use, the impingement air which has acquired certain speed can escape. This has an enormous impact on system efficiency since the air that escapes through these leakage regions loses contact with the casing and, therefore, its main function of cooling same.

To that end, in a particular embodiment, the system further comprises auxiliary sealing elements adapted for covering at least one portion of the periphery of the system for the purpose of containing the fluids exiting the impingement chambers of the panels to the casing.

Advantageously, these auxiliary sealing elements reduce air leakages once the air has exited the panels, and accordingly increase system efficiency.

These auxiliary sealing elements can be additional sheets or metallic gratings the function of which consists of completely or partially plugging up the air leakage path without hindering relative movement as a consequence of thermal expansions.

For this same purpose, in a particular embodiment, the panels have openings adapted for accessing elements that may be covered as they remain between the casing and panels, such as accesses for borescopes, for example.

In a third inventive aspect, the invention provides an assembly comprising:

a compressor or turbine casing, and a tip clearance control system for a compressor or turbine casing according to any of the embodiments of the second inventive aspect, wherein each panel is arranged consecutively on said casing by sandwiching between adjacent panels a sealing element of any of said panels; and wherein said panels are placed such that their respective distribution chambers form a distribution channel around the casing.

In a fourth inventive aspect, the invention provides an assembly method for assembling a tip clearance control system for a compressor or turbine casing according to any of the embodiments of the second inventive aspect on a compressor or turbine casing, wherein the method comprises the steps of:

identifying a cooling air inlet intake and placing the panel with the air inlet in its second sheet close to said cooling air inlet intake; and consecutively placing the rest of the panels by sandwiching between adjacent panels a closure element together with a sealing element of any of said panels, assuring that their respective distribution chambers form a distribution channel around the turbine casing.

Given that each of the panels comprises a closure element together with a sealing element on at least one of its sides, in its most basic configuration, this closure element and sealing element assembly must be arranged between the panel to which it corresponds and an adjoining panel. For example, for each panel forming the system, its associated closure element—sealing element will be placed at the right lateral end thereof, this configuration being repeated for the rest of the panels of the system.

In a particular embodiment, the method further comprises the steps of:

making the seatings formed by the at least one recess and by the at least one prominence of the first sheet and second sheet of each panel coincide with respective first sleeves arranged in the inlets of the casing for sensors;

providing at least one spring element for each seating, preferably with a hole (of the spring element) which substantially coincides with a hole of the recess and a hole of the prominence of the first sheet and second sheet, said spring being configured for exerting a given force on the seating of the panel when it is supported on a second sleeve;

providing a second sleeve for each of the first sleeves of the casing; and placing said spring element on said seating of the panel being retained between the second sleeve and the seating of the panel when the first sleeve and second sleeve are integrally attached to one another.

In other words, according to this embodiment, the panel is not screwed directly to the casing and a movement according to the plane defined by the planar locations of the bosses of the casing which absorbs the differential expansion between the casing and panel is thereby allowed.

More specifically, the integral attachment of the first sleeve and second sleeve would correspond with the former bosses according to the described solutions of the state of the art. Thus, the first sleeve would comprise at one end the planar location on which the seating of the panel is supported.

As mentioned above, if for that panel there are no accesses to the casing for introducing sensors and planar locations have been arranged in the casing in the form of first sleeves (lower half of the former bosses) arranged in their place, making these seatings of the panel coincide with the planar locations of the second sleeves arranged for such purpose will be considered equivalent.

In a fifth inventive aspect, the invention provides a securing system for securing a panel for tip clearance control on a compressor or turbine casing, wherein the panel comprises at least one seating, preferably adapted for the passage of sensors to the casing, said securing system being formed by:

a first sleeve adapted for being arranged in an inlet for sensors of the casing, the end of which is configured for serving as a support for a surface of the seating of the panel, a spring element configured for exerting a given force on the seating of the panel when it is supported on a second sleeve; and a second sleeve the end of which is adapted for being seated on the spring element and configured for being integrally attached to the first sleeve by attachment means;

such that a sliding of the panel in relation to the casing is allowed when the securing system is subjected to a force that is greater than the friction exerted by the spring element.

Said force will be understood to be induced by the expansion movements of the casing during its expansion.

In a preferred embodiment, said spring element is formed by a plate and at least one spring washer such that:

the plate is configured for being arranged between the second sleeve and the seating of the panel; and the at least one spring washer is configured for being arranged between the end of the second sleeve and the plate.

To maximize the contact area, the plate can comprise a surface similar to the upper end ("planar location") of the first sleeve. In this embodiment, the plate is a floating element, allowing movement of the panel on the casing. Preferably, the plate comprises a hole which substantially coincides with the hole of the recess and the prominence of the first sheet and second sheet, respectively, which form the seating.

In an alternative embodiment, said spring element is made up of a plate like in the preceding embodiment and a wave washer arranged between the plate and the second sleeve.

In other words, the panel is confined between the first sleeve and the plate, according to a force defined by the pushing of the spring washer, whether it is a Belleville washer or wave washer (which would be equivalent to a spring-type elastic element), whereas the first sleeve and second sleeve are integrally attached to one another. Thus, despite being sufficiently secured, it allows the panel to slide between said second sleeve and the plate under thermal expansion loads.

In other words, the attachment of the first sleeve and second sleeve would correspond with the former bosses according to the described solutions of the state of the art. Nevertheless, according to the invention, these bosses are divided into two sleeves, the ends of which have complementary surfaces (i.e., the same plane of section at their respective ends) to enable their integral attachment forming a whole.

The attachment means are preferably nuts and bolts, such as, for example, at least one screw attaching the first sleeve and second sleeve en bloc (i.e., integrally), or a threaded attachment between both sleeves, or even an auxiliary internal thread between sleeves.

Preferably, these attachment means in the form of nuts and bolts can go through the plate and the at least one spring washer, or else be arranged separated from one another and placed next to these components so as not to intervene with them.

DESCRIPTION OF THE DRAWINGS

These and other features and advantages of the invention will become more apparent based on the following detailed description of a preferred embodiment given only by way of illustrative and non-limiting example in reference to the attached drawings.

DETAILED DESCRIPTION OF THE INVENTION

Figure 1:
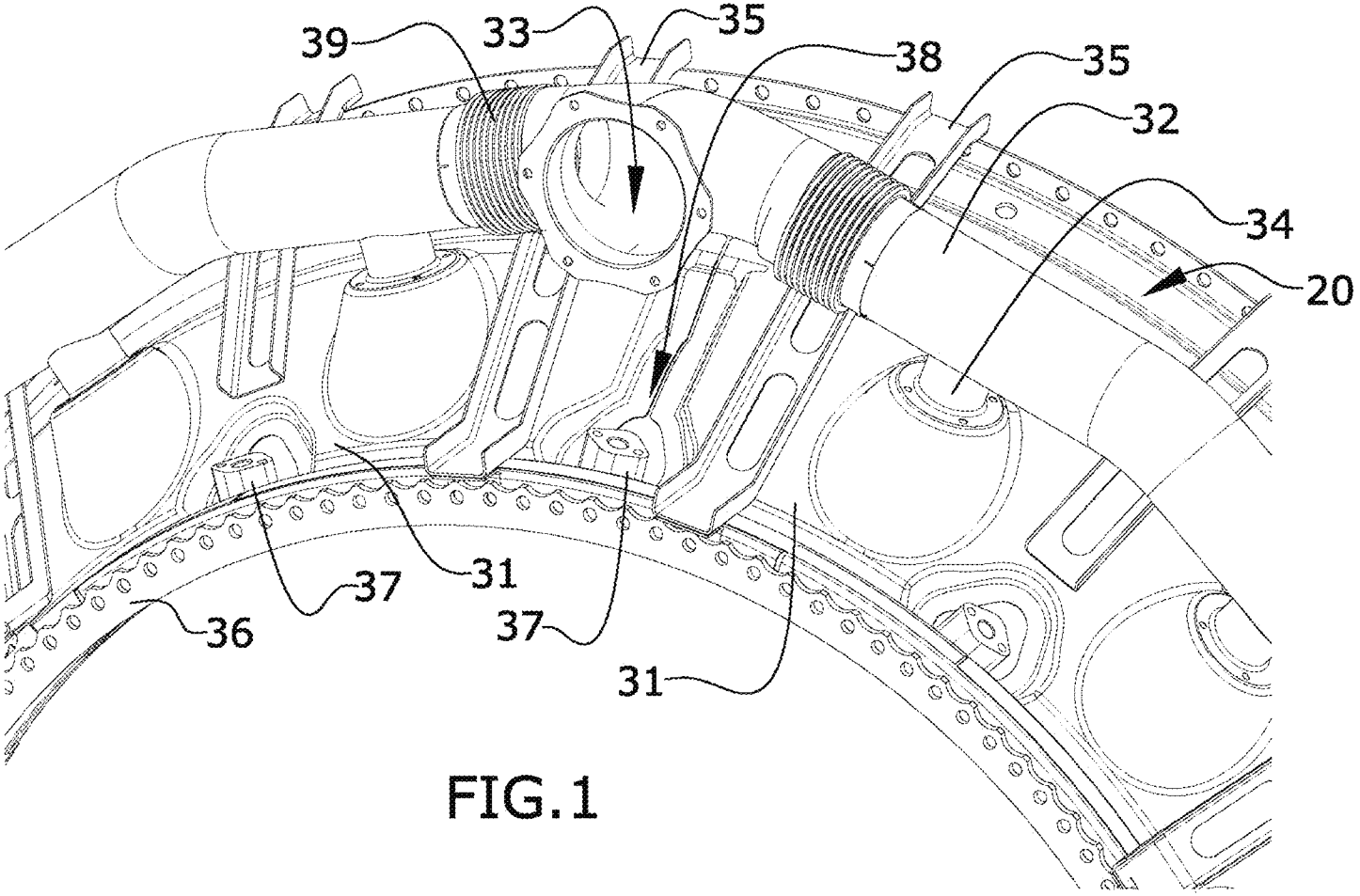
FIG. 1 shows a conventional TCC system.

One skilled in the art will recognize that the details described herein can be applied interchangeably to a panel (1) for tip clearance control, to a system (10) formed by a plurality of these panels (1), to an assembly method or even to a securing system for securing a panel on an engine or turbine casing (20).

Notwithstanding what is shown herein, that is, a turbine casing (20), other embodiments with compressor casings (20) can likewise be considered.

FIG. 1 illustrates a conventional TCC system. These conventional TCC systems are made up a series of impingement chambers (31) arranged on the turbine, or compressor, casing (20), as well as an air distribution duct (32) which receives the cooling air through a T-shaped inlet (33) and conveys it around the casing (20) to said chambers (31). The passage of this cooling air or feeding to the chambers is performed on an isolated basis by means of elbow fittings (34) provided for that purpose.

The chambers (31) are secured to the casing (20) through stair-type securing elements (35) which in turn are secured to respective engine flanges (36), the front flange and rear flange of the casing (20).

The bosses (37) which allow servicing the turbine can be furthermore observed, and their presence is what separates the chambers from one another and gives rise to extensive regions with an air leakage propensity, as well as shadow regions (38) (i.e., where there is no impingement in the casing) as those regions are not covered with chambers (31). Thus, this impingement air furthermore escapes around same.

Finally, to absorb possible expansions, the sections of the distribution duct (32) are connected by means of "bellows"-type connections (39).

The present invention as described hereinafter according to the first inventive aspect is a panel (1) for tip clearance control adapted for being placed on a compressor or turbine casing (20) covering an arc portion thereof.

Figure 2A:
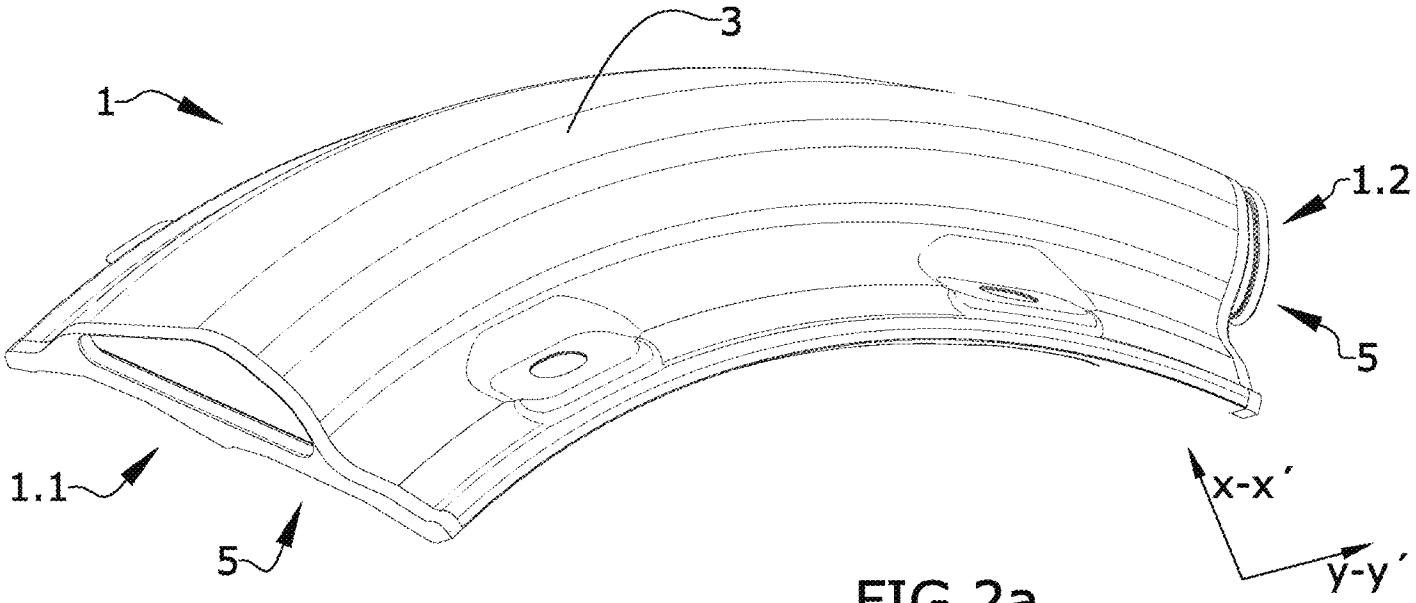
FIG. 2*a* shows a panel for tip clearance control according to the present invention.

FIG. 2*a* illustrates an embodiment of a panel (1) according to the invention.

It can clearly be observed that the system according to the invention is more compact, which results in lightness and, in this case, also in simplicity. It should be taken into account that in aviation, engines are usually exposed, hanging from the wings (pylon) in the most typical configuration. As a result, the entire additional space that is not intended for the operations of the engine per se may give rise to high aerodynamic loads (drag) having a secondary effect on fuel consumption.

Furthermore, compared to the conventional TCC system explained in FIG. 1 that weights 30 kg, the system (10) made up of a plurality of these panels (1) as shown in FIG. 8 reduces this by one third, i.e., to 20 kg as nuts and bolts and additional elements are dispensed with and are now unnecessary as a result of its compact design.

Figure 2B:
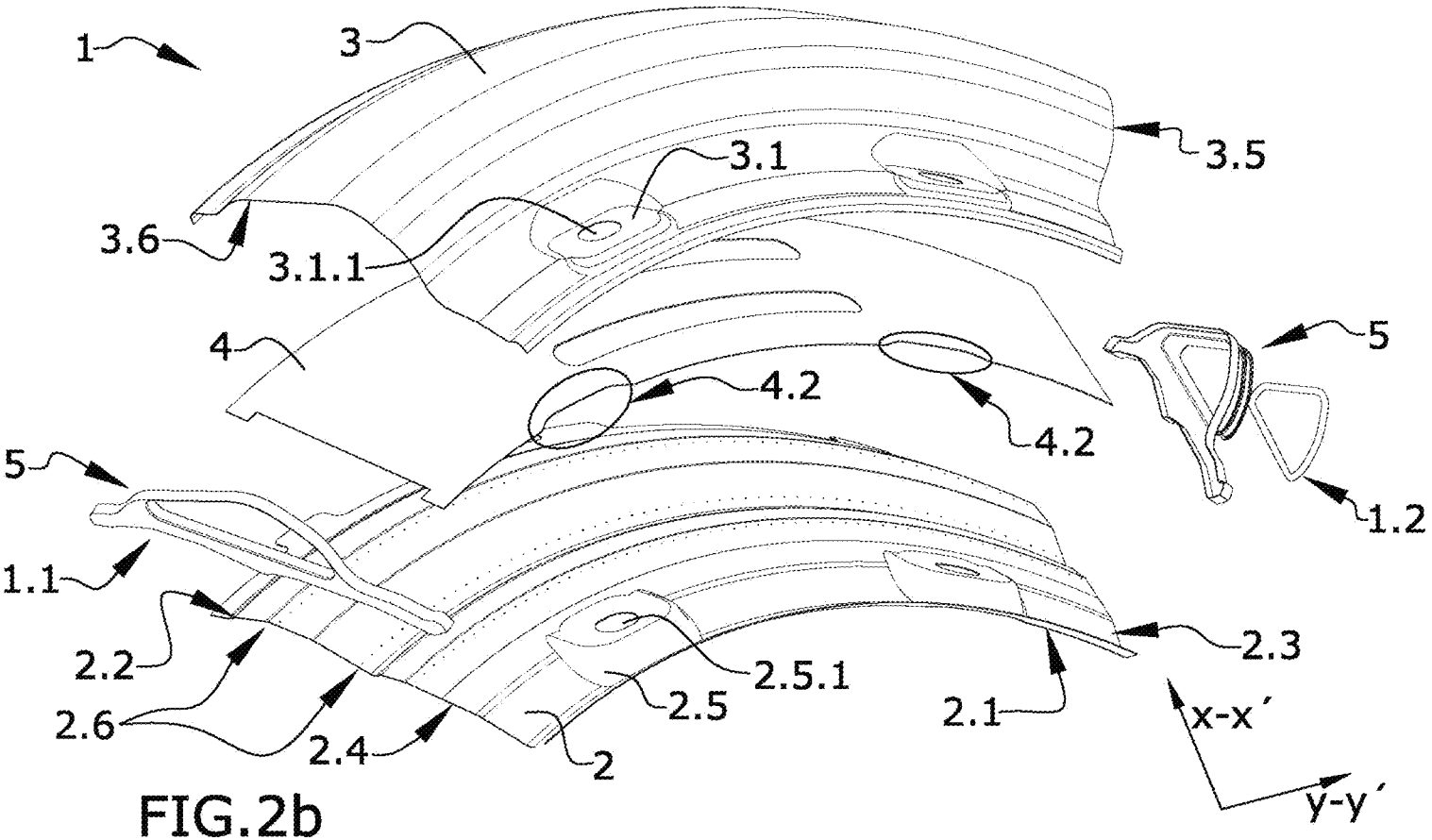
FIG. 2*b* shows an exploded view of the panel of FIG. 2*a*.

FIG. 2*b* illustrates an exploded view of the components of the embodiment of the panel (1) according to FIG. 2*a*.

As can be seen in FIG. 2*b*, the panel (1) is formed in its most basic configuration by:

a first perforated sheet (2) adapted for being arranged on said arc portion of the casing (20);

a second sheet (3) arranged on said first sheet (2) and configured for being attached in a leak-tight manner by its front end (2.1) and rear end (2.2), leaving a gap between both sheets (2, 3); and a third sheet (4) arranged between the first sheet (2) and second sheet (3), configuring respective gaps with both sheets (2, 3) such that the third sheet (4) forms together with the second sheet (3) a distribution chamber (X), whereas it forms with the first sheet (2) an impingement chamber (Y), both chambers (X, Y) extending from one lateral end (1.1) of the panel (1) to the other (1.2); wherein said third sheet (4) comprises at least one hole (4.1) for the passage of fluid between both chambers (X, Y);

wherein the panel (1) further comprises a closure element (5) together with a sealing element at least at one of the lateral ends (1.1,1.2) of the panel, said closure element (5) being configured for allowing the passage of fluid with another adjacent panel (1), whereas the sealing element is configured for allowing relative movement between both adjoining panels (1).

The perforations (2.6) in the first perforated sheet (2) which enable the impingement process are shown. Furthermore, it can be seen how the first sheet (2) has a geometry suitable for being placed on the casing (20), optimizing the impingement on its upper cover.

As already mentioned, the first sheet (2) defines two axes, a longitudinal axis (x-x') and another circumferential axis (y-y'), which aid in referencing its front end (2.1) and rear end (2.2), both substantially parallel to the circumferential axis (y-y'); as well as its two lateral ends (2.3, 2.4), which are substantially parallel to the longitudinal axis (x-x').

As can be seen, the first perforated sheet (2) further comprises at least one recess (2.5) with a hole (2.5.1); and the second sheet (3) further comprises at least one prominence (3.1) the hole (3.1.1) of which is similar to the preceding hole (2.5.1). These at least one recess (2.5) and at least one prominence (3.1) of respective sheets (2, 3) coincide (see FIG. 2*c*) with one another so that when the recess (2.5) is supported on the prominence (3.1) a seating is formed, which is preferably adapted for the passage of sensors to the casing (20) by means of their respective holes (2.5.1, 3.1.1).

Although it cannot be seen in this view, the panel further comprises at least one lug (6) at its rear end for stabilizing the seating of the panel (1) on the casing (20). See FIG. 7 for greater detail.

Now referring to the second sheet (3), the sheet is divided, according to the longitudinal direction (x-x'), into a front section (3.2) and a rear section (3.3), each one extending to its lateral ends (3.5, 3.6). Both sections can be readily distinguished as a result of the rear section (3.3) being prominent with respect to the front section (3.2) so as to form the distribution chamber (X) together with the third sheet (4).

As a result, the third sheet (4) comprises an extension similar to the perimeter of said rear section (3.3) of the second sheet (3) to favor the sealing of air along this perimeter. Furthermore, based on the number of seatings the panel has, the third sheet (4) is provided with a similar number of notches adapted to the shape of the respective recess and prominence that form it.

Moreover, two closure elements (5) are also shown in FIG. 2*a*, one on each side of the panel (1). Nevertheless, in a panel system (10) such as the one shown in FIG. 8, it is necessary for a closure element (5) together with its sealing element to be placed between two panels (1), so each panel (1) will be provided with at least one closure element (5).

Preferably, this panel (1) comprises a "male"-type closure element (5) at one of its ends and a "female"-type closure element (5) at the opposite end, thus only one of said closure elements (5) will comprise the retaining means for the sealing element. That is, the closure element (5) of its end (1.2) has the retaining means for the sealing element, whereas that of its other lateral end (1.1) will have a ridge adapted for supporting the sealing element of the adjoining panel.

Figure 4A:
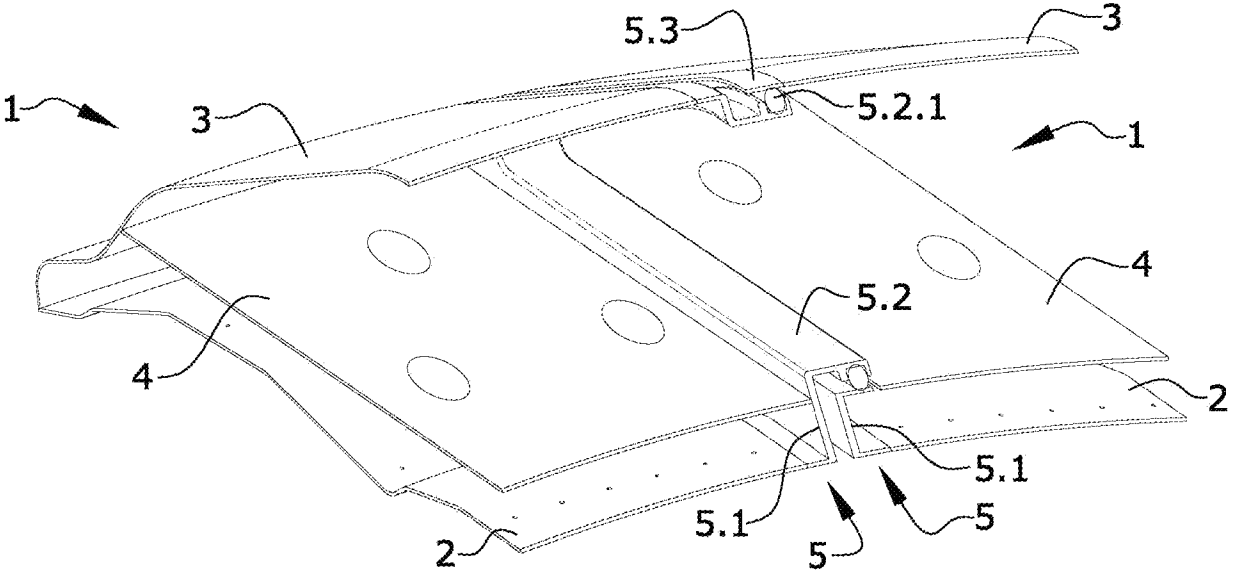
FIGS. 4*a*-4*b* show an embodiment of the closure element together with the sealing element (FIG. 4*a*), in addition to an example of operation under thermal expansion of the casing (FIG. 4*b*).
Figure 4B:
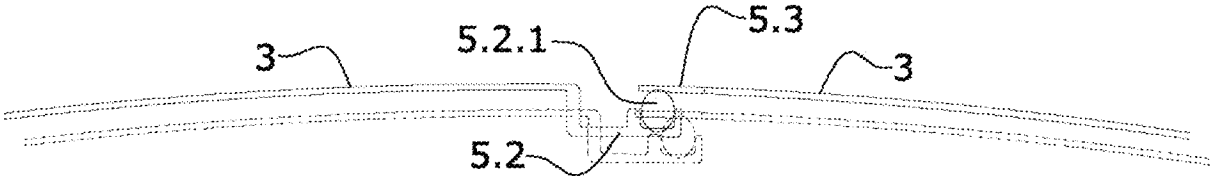
Figure 5:
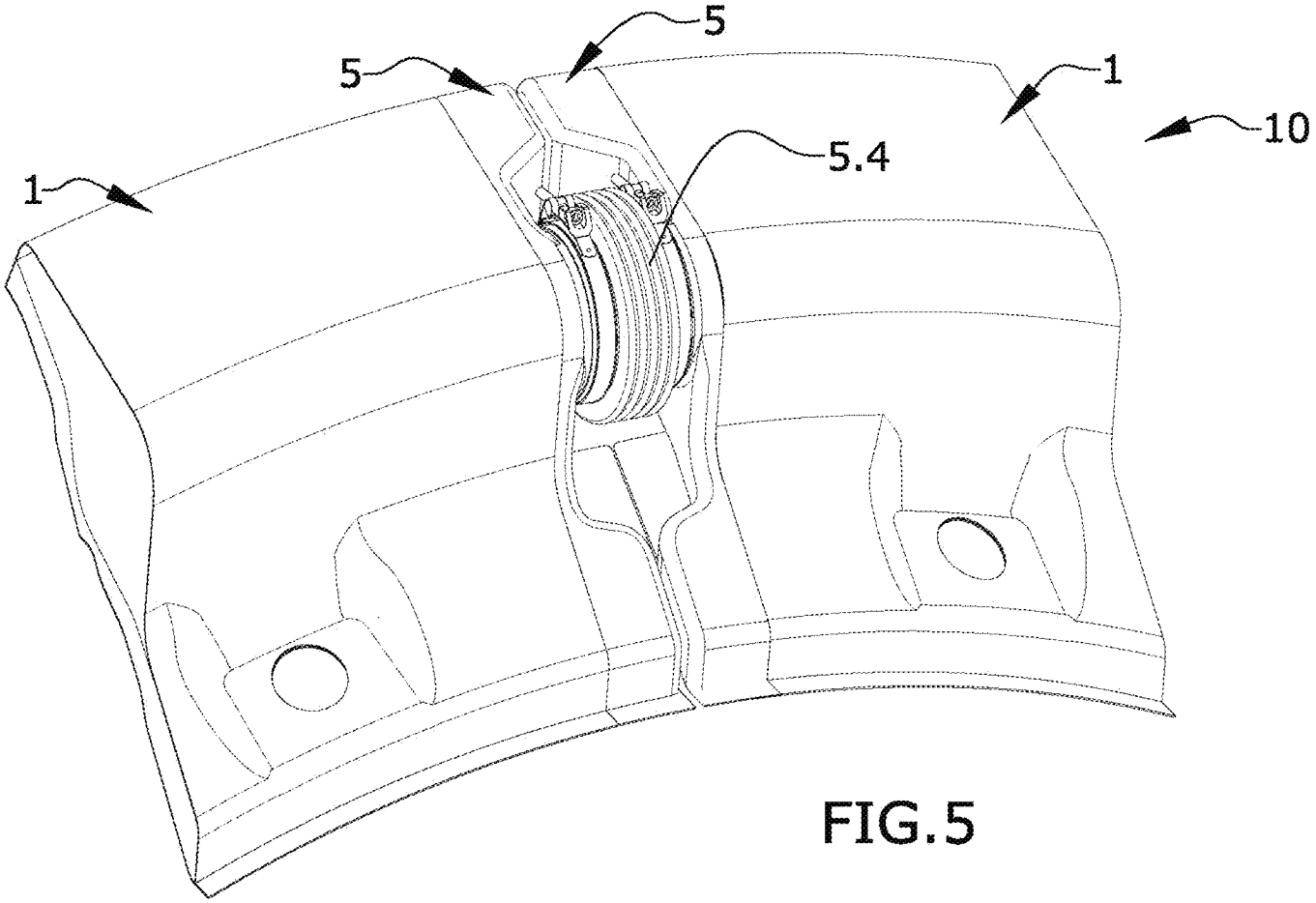
FIG. 5 shows an alternative embodiment in which the sealing element is a bellows-type sealing element.

The sealing element can be seen in greater detail in FIGS. 4*a* to 5.

Returning to the closure elements (5), each of them is configured for sealing or closing an end of the impingement chamber (Y) between the first sheet (2) and third sheet (4), while at the same time allowing the passage of air to or from the distribution chamber (X) of an adjacent panel between the second sheet (3) and third sheet (4).

More specifically, as can be seen in detail in FIG. 4*a*, said closure element (5) is integrally attached along the entire contour of a lateral end (1.1, 1.2) of the panel (1) formed by the first sheet (2) and second sheet (3), the closure element (5) comprising:

a sealing plate (5.1) for the end of the impingement chamber (Y), and a ridge (5.2) which laterally extends the contour defined between the second sheet (3) and third sheet (4) such that the passage of air therethrough is allowed.

Moreover, as mentioned, the first sheet, second sheet, and third sheet can be formed from different sheets, giving rise to the three sheets according to the invention after their attachment. Namely, the attachment of a sheet comprising both the front section of the second sheet and the third sheet, together with another sheet in turn comprising the rear section of the second sheet would result in the second sheet and third sheet according to the present invention.

Figure 2C:
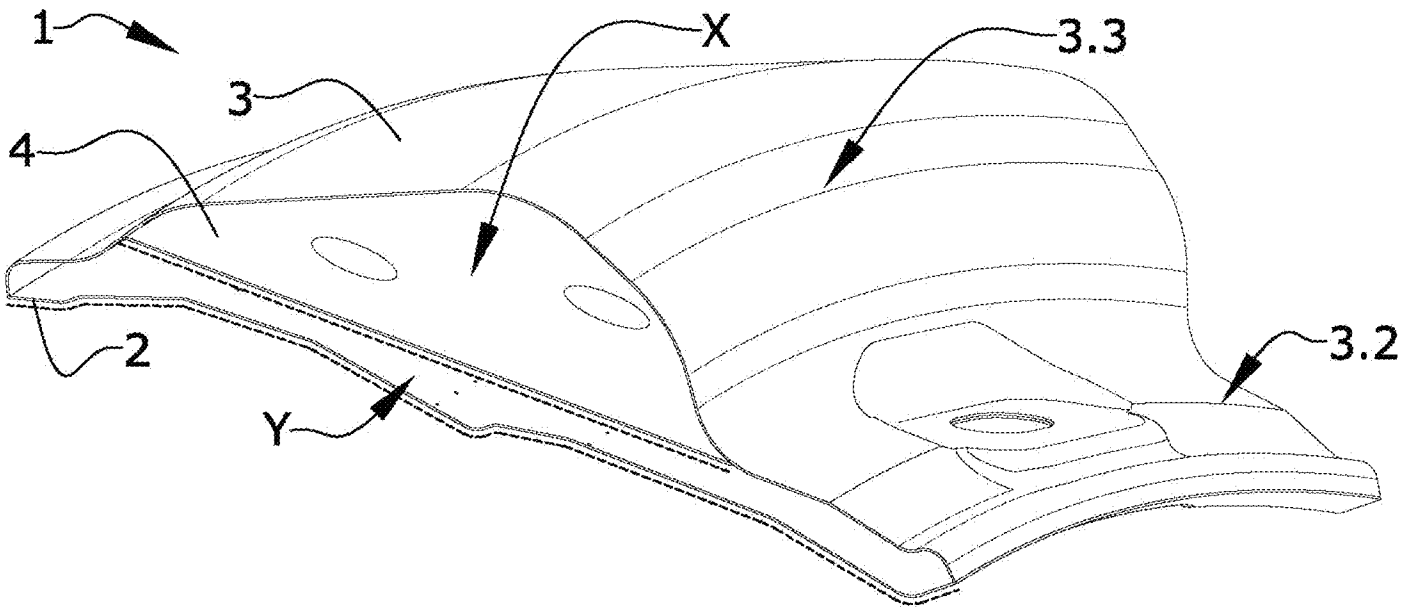
FIG. 2*c* shows a detailed view of a section of the panel according to FIG. 2*a*, showing neither the closure element nor the sealing element.

FIG. 2*c* illustrate in greater detail the inside of the panel (1) shown in FIG. 2*a* as a result of a section view. For the sake of illustration, the section is in its intermediate region, and as a result neither the closure element (5) nor the sealing element has been shown.

However, the third sheet (4) configuring respective gaps (X, Y) together with the first sheet (2) and second sheet (3) giving rise to the distribution chamber (X) and the impingement chamber (Y), respectively, can be seen. It can furthermore be observed that the third sheet ends at the height of the seating formed between the first sheet (2) and second sheet (3), or, in other words, it occupies an extension similar to the planar projection of the rear section (3.3) of the second sheet (3).

It should be pointed out that in a preferred embodiment, the sheets are pressed sheets the attachment of which is produced by welding.

Those surfaces susceptible to the application of thermal insulation, for example, by means of plasma spraying, are indicated with a discontinuous line. These candidate surfaces are either on the first sheet (2) on its face facing the casing (20), or the third sheet (4) on its face facing the impingement chamber (Y), as can be seen.

Figure 3A:
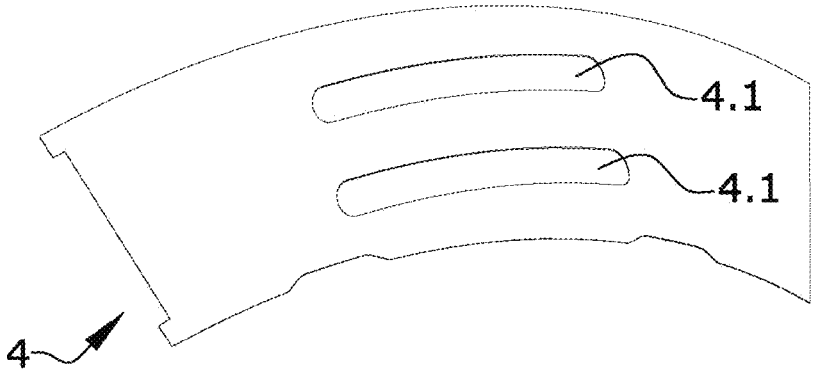
FIGS. 3*a*-3*b* show embodiments of the third sheet.
Figure 3B:
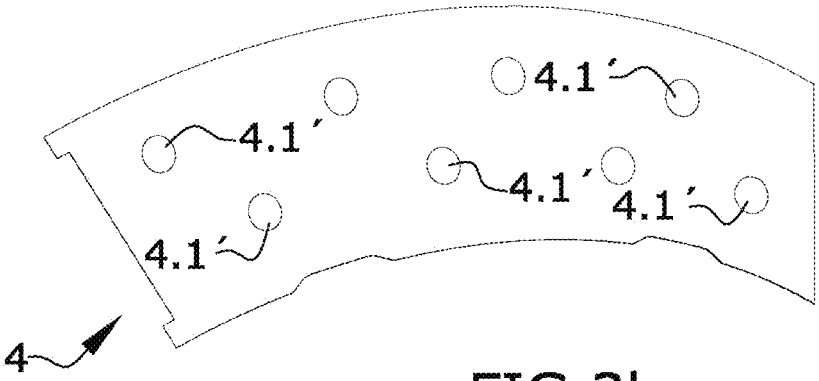

FIGS. 3*a* and 3*b* illustrate detailed embodiments of the third sheet (4). Thus, FIG. 3*a* shows a third sheet (4) comprising two elongated holes (4.1) in the circumferential direction (y-y') and spaced apart according to the longitudinal direction (x-x'), notwithstanding the fact that there could be a single elongated hole. Moreover, FIG. 3*b* shows a third sheet (4) with six holes (4.1'), separated in groups of two according to the circumferential direction (y-y') and spaced apart according to the longitudinal direction (x-x') in groups of three holes (4.1').

This arrangement of holes is for explanatory purposes and, accordingly, one skilled in the art will recognize other patterns, which may or may not be homogenous, of holes having the same or a different morphology with respect to those shown herein. As already mentioned, this allows the distribution of air into the chambers to be completely adaptable, being able to simply exchange the third sheet (4) with another more suitable one.

As a result of these holes (4.1) of the third sheet (4), the operations of the panel in relation to the heat pick-up are improved compared to a conventional TCC system contemplated in the state of the art.

Thus, since there was only one air feed (an intermediate hole) for feeding air into the impingement chamber (31) (as shown in FIG. 1) and it occurred through the elbow fitting (34), the long path of travel of the air from the feeding point (34) to the edges of the chamber (31) caused an increasing gain in temperature up to these edges.

In turn, again referring to the panel according to the invention, as the third sheet (4) can comprise a larger number of holes (4.1) (see FIG. 3*b*), which is favored by the structural simplicity and adaptability of the panel (1), more feed points (4.1) distributed throughout the entire sheet are obtained, and the mean temperature of the cooling air to be injected is therefore reduced.

FIG. 4*a* shows an embodiment of the closure element (5) together with the sealing element (5.2.1) cooperating with an adjacent panel. Particularly, the closure element is similar to the one illustrated in FIG. 2*a*, i.e., it is integrally attached to the contour of a lateral end (1.1) of the panel (1), plugging the impingement chamber (Y) by means of the sealing plate (5.1) and facilitating the passage of air to adjacent panels (1) by means of its ridge (5.2).

Namely, this ridge (5.2), which laterally extends the contour defined between the second sheet (3) and third sheet (4) as if it were a projection, further comprises means for retaining the sealing element (5.2.1).

In this particular example, the ridge (5.2) has an E-shape section, the sealing element, which in this case is an O-ring type elastic gasket (5.2.1), being retained between its two outermost tips.

In turn, the closure element (5) of the adjoining panel (1) (the one on the right) is also integrally attached at a lateral end, plugging its impingement chamber by means of a sealing plate (5.1) and facilitating the passage of air to adjacent panels (1) by means of its ridge (5.3). Unlike the ridge (5.2) of the left panel (1) (the one retaining the sealing element (5.2.1)), this ridge (5.3) of the right panel (5.3) is adapted for supporting on its surface, in this specific case its internal surface, the sealing element (5.2.1).

In a preferred embodiment, one and the same panel comprises two closure elements (5) as has been explained, but only one of them incorporates the means for retaining the sealing element (5.2.1) (male-female embodiment).

Very briefly, the manner in which said closure element (5) works under thermal expansion of the casing (20) is shown below in FIG. 4*b*.

With respect to FIG. 4*b*, the discontinuous line shows the original position of the closure and sealing elements, that is, when the turbine or compressor are not in operation and accordingly the casing (20) is cold.

The solid line shows how the panel (1) moves upwards and is separated from the adjoining panel when the turbine or compressor is in operation and the casing (20) is hot. To that end, the sealing element (5.2.1) must allow said relative movement when the closure element (5) of the adjoining panel (1) slides thereon.

In other words, the sealing element (5.2.1) is retained in a closure element (5) such that sliding of the closure element of the adjoining panel is enabled.

A rotation allowed by this panel configuration could be in the order of an angular misalignment of 10° between adjoining panels. Thus, the sealing element (5.2.1) does not lose contact with the closure element (5) of the adjoining panel (1). In other words, it continues to exercise the function of the radial sealing of the distribution chamber.

As a particular case, FIG. 5 illustrates another embodiment contemplated by the present invention where the sealing element, instead of being an elastic gasket (5.2.1) as defined in the preceding figures, is a bellows-type element (5.4).

Accordingly, as a result of its flexibility, relative movement between adjoining panels during similar operations is likewise favored.

Figure 6A:
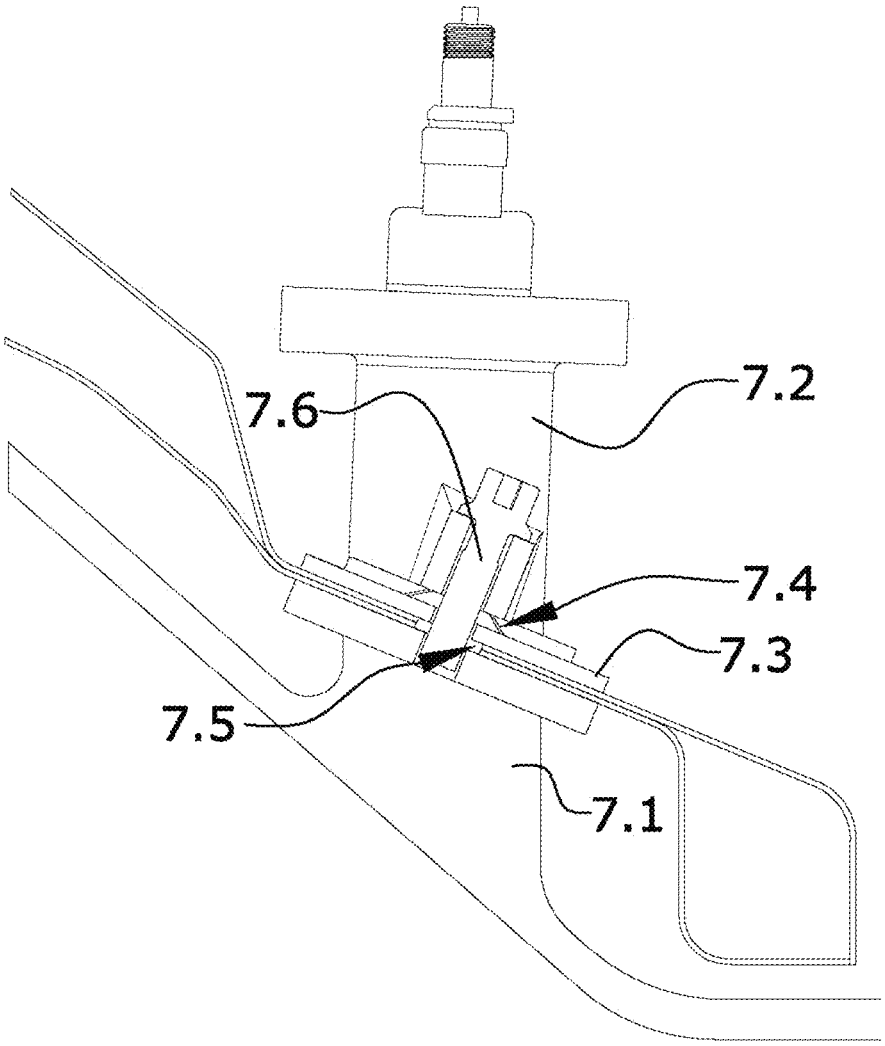
FIGS. 6*a*-6*d* show embodiments of the securing system according to the invention.
Figure 6B:
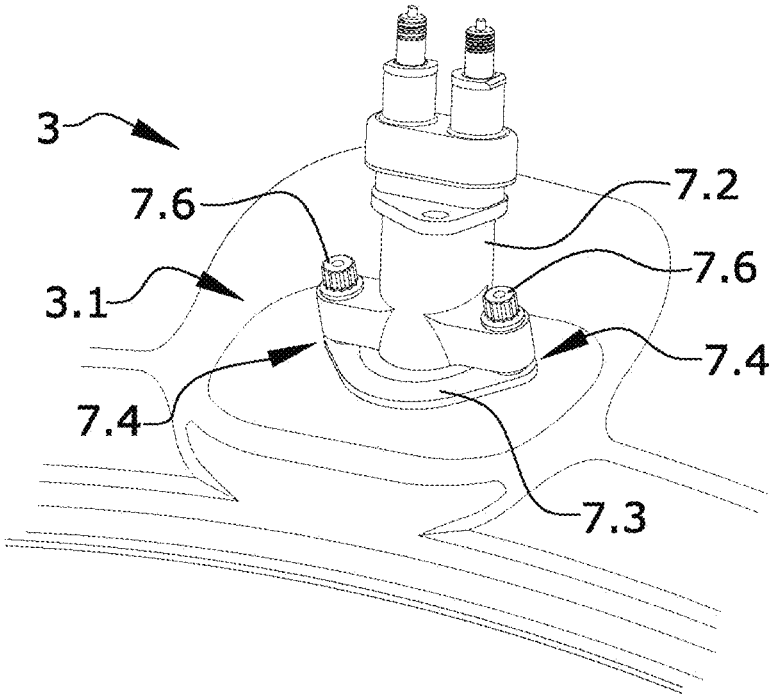
Figure 6C:
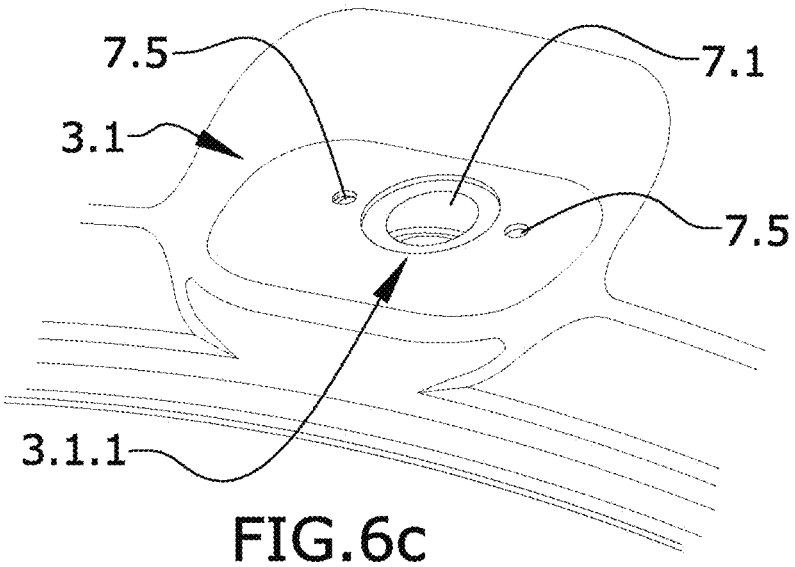

FIGS. 6*a* to 6*c* show a securing system for securing a panel to a compressor or turbine casing (20) at the point where this panel comprises a seating.

In FIG. 6*a*, where the securing system is depicted as a cross-section, it can be seen that this securing system is formed by:

- a first sleeve (7.1) adapted for being arranged in an inlet for sensors of the casing (20), the end of which is configured for serving as a support for a surface of the seating of the panel,
- a spring element (7.3, 7.4) configured for exerting a given force on the seating of the panel when it is supported on a second sleeve (7.2);
- a second sleeve (7.2) the end of which is adapted for being seated on the spring element (7.3, 7.4) and configured for being integrally attached to the first sleeve by attachment means (7.6);
- such that a sliding of the panel in relation to the casing is allowed when the securing system is subjected to a force that is greater than the friction exerted by the spring element (7.3, 7.4).

The spring element is, preferably and in this figure, a plate (7.3) and at least one spring washer (7.4) such that:

- the plate (7.3) may comprise a surface similar to the upper end ("planar location") of the first sleeve (7.1) and is configured for being arranged between the second sleeve (7.2) and the seating of the panel;
- at least one spring washer (7.4) configured for being arranged between the end of the second sleeve and the plate.

Although it cannot be seen in these figures for the sake of illustration, the lower region of the first sleeve (7.1), the region that will contact the casing (20) and is now shown as a whole, would adopt the geometry of the latter so as to be supported thereon. In other words, this support base of the first sleeve (7.1) would adopt the inclination of the casing (20) at that point.

In this particular case, this first sleeve (7.1) and second sleeve (7.2) furthermore guide the sensors into the casing. In their integral attachment, both sleeves (7.1, 7.2) form a conventional boss. It can also be observed that the screws (7.6) are arranged on respective sides of the hole, sensor guide, arranged on the seating of the panel, there being one spring washer (7.4) for each screw (7.6).

When the attachment means (7.6) are based on nuts and bolts for integrally attaching the end of the first sleeve (7.1)

and second sleeve (7.2) to one another, the seating must further comprise holes (7.5) for the passage of these screws (7.6). See FIG. 6*c*.

The similar shape of the end of the first sleeve (7.1), of the end of the second sleeve (7.2), and the shape of the plate (7.3), all of them being rhomboid-shaped, can be seen in FIG. 6*b*.

With a top view like that provided in FIG. 6*c*, the slot in the seating of the panel in which the plate (7.3), the spring washer (7.4), the first sleeve (7.1), and the screw (7.6) will be arranged in that order, can be seen.

Figure 6D:
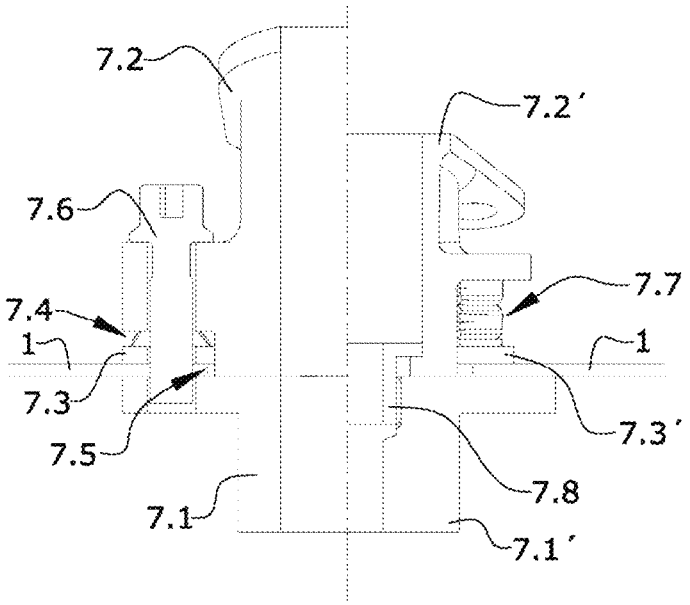

Furthermore, FIG. 6*d* shows another embodiment of the securing system for securing a panel to the casing (20) based on a floating plate and a wave washer (7.7) as the spring element.

Namely, it shows a comparative image of a securing system according to the embodiment of FIG. 6*a* (based on the plate (7.3)-spring washer (7.4) assembly) and another one based on a plate (7.3')-wave washer (7.7) assembly, with said wave washer being the spring element.

In particular, a section of both configurations according to the longitudinal direction (x-x') (i.e., from front to back of the axis of the engine) using the axis of symmetry of the bearing, is shown.

Both securing systems use a first sleeve (7.1, 7.1') and a second sleeve (7.2, 7.2') integrally attached to one another by attachment means. In the left half, these attachment means are based on nuts and bolts (7.6), whereas in the right half an auxiliary internal thread (7.8) is used.

Notwithstanding the foregoing, attachment means with a different typology can be used or those which are herein depicted could even be interchanged. Namely, in case of using nuts and bolts with the system on the right (plate (7.3')-wave washer (7.7) assembly), the second sleeve could also comprise extensions exceeding the diameter of the wave washer (7.7) so as to be integrally attached with the first sleeve remotely so that it does not interfere with the spring element.

Returning to FIG. 6*d*, it can be observed how the holes of the seating have a diameter that is slightly larger than the diameter occupied by the elements going through it, whether the second sleeve (7.2, 7.2') or even the screws (7.6). This enables the sliding of the panel without being contained by the retention of these elements, or in other words, the holes of the panel are sized so as to allow the envisaged sliding (or relative movement) of the panel when accommodating the expansion of the casing (20).

Figure 7:
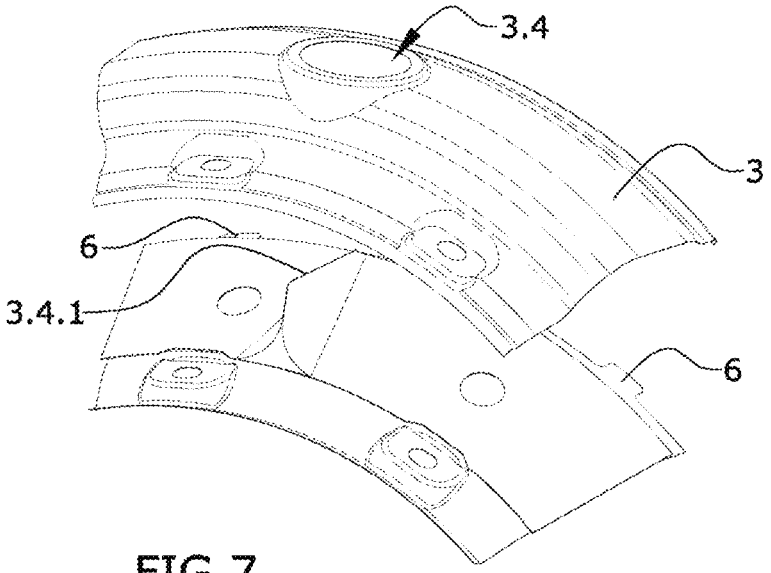
FIG. 7 shows an example of an air inlet of the second sheet connecting with the distribution chamber.

FIG. 7 illustrates an air inlet which is arranged in the second sheet (3) and connects with the distribution chamber (X). Furthermore, a distributing element (3.4.1) favoring the division of the air inflow into two opposite branches can be observed.

Figures 8A, 8B, 8C:
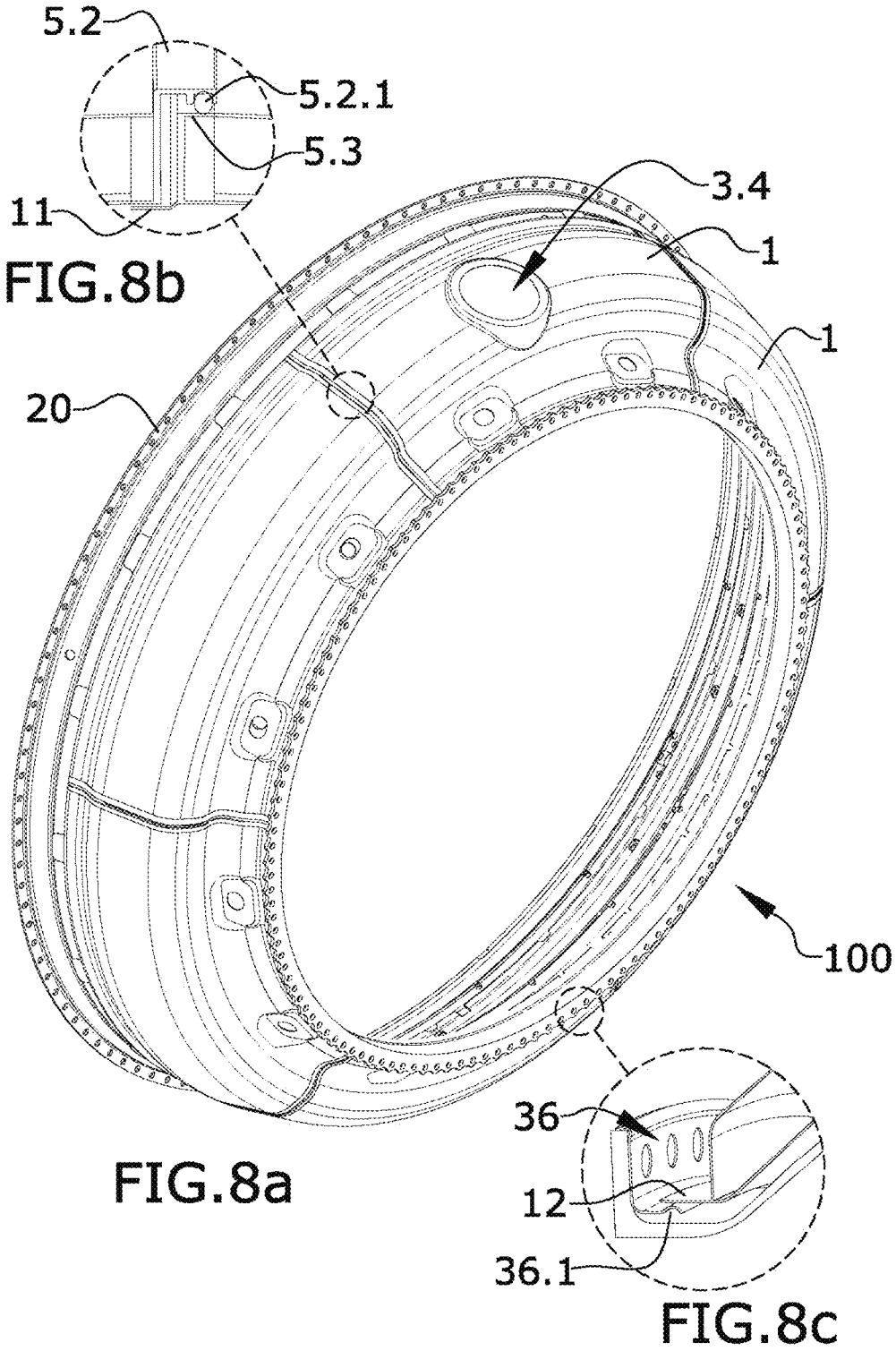
FIGS. 8*a*-8*c* show a system formed by a plurality of panels according to the present invention.

FIG. 8*a* shows a system (10) for tip clearance control formed by a plurality of panels (1) according to the invention, wherein at least one of said panels (1) is as illustrated and described in relation to FIG. 7.

Furthermore, in use, for the purpose of preventing post-impingement leakages, i.e., once the air exits the panel (1) through the first perforated sheet (2), the system (10) is provided with auxiliary sealing elements (11, 12). These auxiliary elements (11, 12) can be located, inter alia, close to the engine flange (36) and following its path, as shown in FIG. 8*c*.

FIG. 8*b* shows a detail of the auxiliary longitudinal sealing element (11). This element (11) is integrally attached to the closure element (5), namely the one that does not comprise the O-ring type elastic gasket (5.2.1). It is a ridge or flap in the form of a continuous tab extending below the adjacent panel, hindering possible air leakages through the opening between panels.

Its length is longer, i.e., overlapping the adjacent panel, so that in operation (hot state with the panels separated the maximum distance) it still has a part that overlaps the adjacent panel and can continue to perform its function.

Moreover, FIG. 8*c* shows a detail of the auxiliary longitudinal sealing element (12). This element (12) is also in the form of a continuous ridge or tab arranged on the front end of the panels and being supported on a bend (36.1) of the engine flange (36).

The invention claimed is:

1. A panel for tip clearance control adapted for being placed on a compressor or turbine casing covering an arc portion thereof, wherein the panel is formed by:

a first perforated sheet adapted for being arranged on said arc portion of the casing said first sheet defining two axes, a longitudinal axis and a circumferential axis, wherein said first perforated sheet further comprises a front end and a rear end, both substantially parallel to the circumferential axis; as well as two lateral ends substantially parallel to the longitudinal axis;

a second sheet arranged on said first sheet and configured for being attached in a leak-tight manner at its front end and rear end, leaving a gap between the first perforated sheet and the second sheet; and a third sheet arranged between the first sheet and second sheet, configuring respective gaps with the first perforated sheet and the second sheet such that the third sheet forms together with the second sheet a distribution chamber, whereas it forms with the first sheet an impingement chamber, both chambers extending from one lateral end of the panel to the other; wherein said third sheet comprises at least one hole for the passage of fluid between both chambers;

wherein the panel further comprises a closure element together with a sealing element at least at one of the lateral ends of the panel, said closure element being configured for allowing the passage of fluid with another adjacent panel, whereas the sealing element is configured for allowing relative movement between both adjoining panels.

2. The panel according to claim 1, wherein:

the first perforated sheet further comprises at least one recess; and the second sheet further comprises at least one prominence;

such that said at least one recess and at least one prominence of respective sheets coincide with one another so that when the recess is supported on the prominence a seating is formed.

3. The panel according to claim 2, wherein the seating is adapted for the passage of sensors to the casing.

4. The panel according to claim 1, wherein:

the second sheet is divided according to the longitudinal direction into a front section and a rear section, each one of said front section and said rear section extending to its lateral ends; wherein said rear section is prominent with respect to the front section so as to form the distribution chamber together with the third sheet; and the third sheet has an extension configured to seal its perimeter with said rear section of the second sheet and thus prevent the passage of air to the impingement chamber through the attachment between the second sheet and third sheet.

5. The panel according to claim 1, wherein the second sheet further comprises an air inlet in fluid communication with the distribution chamber.

6. The panel according to claim 5, wherein said air inlet of the second sheet further comprises a distributing element configured for splitting an air inflow into branches.

7. The panel according to claim 6, wherein the branches into which the air inflow is split are two opposite branches.

8. A system for tip clearance control formed by a plurality of panels according to claim 5.

9. The system according to claim 8, wherein the system further comprises auxiliary sealing elements adapted for covering at least one portion of the periphery of the system for the purpose of containing the fluids exiting the impingement chambers of the panels to the casing.

10. An assembly comprising:

a compressor or turbine casing, and a tip clearance control system for a compressor or turbine casing according to claim 8, wherein each panel is arranged consecutively on said casing by sandwiching between adjacent panels a sealing element of any of said panels; and wherein said panels are placed such that their respective distribution chambers form a distribution channel around the casing.

11. An assembly method for assembling a tip clearance control system for a compressor or turbine casing according to claim 8 on a compressor or turbine casing, wherein the method comprises the steps of:

identifying a cooling air inlet intake and placing the panel with the air inlet in its second sheet close to said cooling air inlet intake; and consecutively placing the rest of the panels by sandwiching between adjacent panels a closure element together with a sealing element of any of said panels, assuring that their respective distribution chambers form a distribution channel around the casing.

12. The assembly method according to claim 11, wherein the method further comprises the step of:

making the seatings formed by the at least one recess and by the at least one prominence of the first sheet and second sheet of each panel coincide with respective first sleeves arranged in the inlets of the casing for sensors;

providing at least one spring element for each seating, said spring being configured for exerting a given force on the seating of the panel when it is supported on a second sleeve;

providing a second sleeve for each of the first sleeves of the casing; and placing said spring element on said seating of the panel being retained between the second sleeve and the seating of the panel when the first sleeve and second sleeve are integrally attached to one another.

13. The assembly method according to claim 12, wherein the at least one spring element provided for each seating comprises a hole which coincides with the holes of the recess and the prominence of the first sheet and second sheet.

14. The panel according to claim 1, wherein the closure element is configured for closing an end of the impingement chamber between the first sheet and third sheet, while at the same time allowing the passage of air to or from the distribution chamber of an adjacent panel between the second sheet and third sheet, whereas the sealing element is configured for contacting the adjacent panel such that it seals against fluid leakages at the distribution chamber between the panel and the adjacent panel.

15. The panel according to claim 14, wherein the at least one closure element is integrally attached along the entire contour of a lateral end of the panel formed by the first sheet and second sheet, the closure element comprising:

a sealing plate for the end of the impingement chamber, and a ridge which laterally extends the contour defined between the second sheet and third sheet such that the passage of air therethrough is allowed; wherein said ridge comprises means for retaining the sealing element.

16. The panel according to claim 15, wherein the sealing element is an O-ring type elastic gasket.

17. The panel according to claim 1, wherein the at least one closure element is integrally attached along the entire contour of a lateral end of the panel formed by the first sheet and second sheet, the closure element comprising:

a sealing plate for the end of the impingement chamber, and a ridge on the contour defined between the second sheet and third sheet such that the passage of air therethrough is allowed; and this ridge being adapted for supporting a sealing element of an adjoining panel.

18. The panel according to claim 1, wherein the first sheet and/or the third sheet comprise a thermal insulation at least on one of their respective faces.

19. The panel according to claim 18, wherein the thermal insulation is applied by means of plasma spraying.

20. A securing system for securing a panel for tip clearance control on a compressor or turbine casing, wherein the panel comprises at least one seating, said securing system being formed by:

a first sleeve adapted for being arranged in an inlet for sensors of the casing, wherein an end of said first sleeve is configured for serving as a support for a surface of the seating of the panel, a spring element configured for exerting a given force on the seating of the panel when it is supported on a second sleeve;

said second sleeve comprising an end adapted for being seated on the spring element and configured for being integrally attached to the first sleeve by attachment means;

such that a sliding of the panel in relation to the casing is allowed when the panel is subjected to a force that is greater than the friction exerted by the spring element.

21. The securing system according to claim 20, wherein the seating is adapted for the passage of sensors to the casing.

* * * * *